US007967523B2

(12) United States Patent
Hetzler et al.

(10) Patent No.: US 7,967,523 B2
(45) Date of Patent: Jun. 28, 2011

(54) TRENCH DRAIN ASSEMBLY

(75) Inventors: Roy Hetzler, Hendersonville, NC (US); Bushra A. Ghaly, Burlington (CA)

(73) Assignee: Watts Water Technologies, Inc., North Andover, MA (US)

( * ) Notice: Subject to any disclaimer, the term of this patent is extended or adjusted under 35 U.S.C. 154(b) by 87 days.

(21) Appl. No.: 12/286,958

(22) Filed: Oct. 3, 2008

(65) Prior Publication Data

US 2009/0097921 A1 Apr. 16, 2009

Related U.S. Application Data

(60) Provisional application No. 60/977,696, filed on Oct. 5, 2007.

(51) Int. Cl.
*E01C 11/22* (2006.01)

(52) U.S. Cl. ..... 404/4; 404/2; 405/118

(58) Field of Classification Search ..... 52/11–13, 52/15–16; 405/118–123; 210/170, 747, 210/163, 164; 249/10, 11; 404/2–5
See application file for complete search history.

(56) References Cited

U.S. PATENT DOCUMENTS

| | | | | |
|---|---|---|---|---|
| RE26,366 | E * | 4/1968 | Flegel | 404/2 |
| 4,844,655 | A * | 7/1989 | Aleshire | 405/118 |
| 7,264,418 | B1 * | 9/2007 | Houck et al. | 405/43 |
| 7,637,694 | B1 * | 12/2009 | Musser | 405/118 |
| 2007/0293008 | A1 * | 12/2007 | Hodgekins et al. | 438/270 |

FOREIGN PATENT DOCUMENTS

EP 9835 A * 4/1980

* cited by examiner

*Primary Examiner* — Sunil Singh
(74) *Attorney, Agent, or Firm* — Edwards Angell Palmer & Dodge LLP; George N. Chaclas

(57) ABSTRACT

A trench drain assembly including a flow channel and a frame for supporting the channel in a trench. Sidewalls of the frame have a gradually increasing height between ends of the frame so that the frame creates a gradual slope for the assembly to properly drain. In addition, sidewalls of the frame include spaced lugs that extend outwardly and sidewalls of the channel include spaced lugs that extend inwardly to create an interference fit with the lugs of the frame so that the channel can be easily attached to the frame. During assembly, the frame is lowered onto the channel so that the lugs of the frame are received between the lugs of the channels and the frame is then slid with respect to the channel until the lugs of the frame are positioned below the lugs of the channel to secure the frame to the channel.

19 Claims, 14 Drawing Sheets

TRENCH DRAIN ASSEMBLY

CROSS-REFERENCE TO RELATED APPLICATION

This application claims priority to U.S. Provisional Patent Application No. 60/977,696, filed Oct. 5, 2007, which is incorporated herein by reference.

TECHNICAL FIELD OF THE DISCLOSURE

This disclosure relates generally to the field of trench drains and, more particularly to a trench drain assembly including a flow channel, a frame for supporting the channel, and a grate for covering the channel, wherein the channel is easily attached to the frame and the frame creates a gradual slope for the channel to properly drain.

BACKGROUND OF THE DISCLOSURE

The general concept of trench drains is well known in the prior art. Trench drains are used where extensive amounts of liquid must be moved from one place to another. For example, trench drains are used for collecting rainwater from parking lots and transporting the rainwater to a drainage sewer. Typically, trench drains are U-shaped or V-shaped channels and are installed in the ground and secured in concrete. In many cases, the trench drains include a grate to prevent large debris and people from falling into them.

Some prior art trench drains include plastic channels, which can be left in place after concrete has been poured into the trench containing the drain. The plastic channels act as a form and a liner for the concrete. The manufacture and transportation costs associated with plastic channels are significantly less than prior art metal or cast concrete channels. Often, the plastic channels are supported by metal frames, which are bolted to the channels. The plastic channels include sidewalls that have gradually increasing heights along the length of the channel, which creates a gradual slope for the channel to properly drain fluid, such as rainwater. The frame is leveled in the trench and the sloping channel is bolted to the frame. Many successively taller channels are connected end-to-end to provide a long length of trench drain. For example, to create a one hundred foot length of continuous trench drain might require 10 ten-foot lengths of channel connected end-to-end wherein each successive channel is deeper than the previous channel. Thus in this example at least ten different channel pieces are required to be molded.

What is still desired is a new and improved trench drain assembly including a flow channel, a frame for supporting the channel, and a grate for covering the channel. Preferably, the new and improved trench drain assembly will allow the frame and the channel to be easily secured together without tools and without separate fasteners. In addition, the new and improved trench drain assembly will preferably require fewer different-sized channel pieces to create long spans of trench drain.

SUMMARY OF THE DISCLOSURE

The present disclosure provides a trench drain assembly including a flow channel and a frame for supporting the channel in a trench, wherein sidewalls of the frame have a gradually increasing height between ends of the frame and sidewalls of the channel have a fixed height between ends of the channel so that only the frame creates a gradual slope for the assembly to properly drain.

The present disclosure also provides a trench drain assembly including a flow channel and a frame for supporting the channel in a trench, wherein sidewalls of the frame include spaced lugs that extend outwardly and sidewalls of the channel include spaced lugs that extend inwardly to create an interference fit with the lugs of the frame so that the channel can be easily attached to the frame. During assembly, the frame is lowered onto the channel so that the lugs of the frame are received between the lugs of the channels and the frame is then slid with respect to the channel until the lugs of the frame are positioned below the lugs of the channel to secure the frame to the channel.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF DRAWINGS

Reference is made to the attached drawings, wherein elements having the same reference character designations represent like elements throughout, and wherein.

DETAILED DESCRIPTION OF EXEMPLARY EMBODIMENTS

Figure 1:
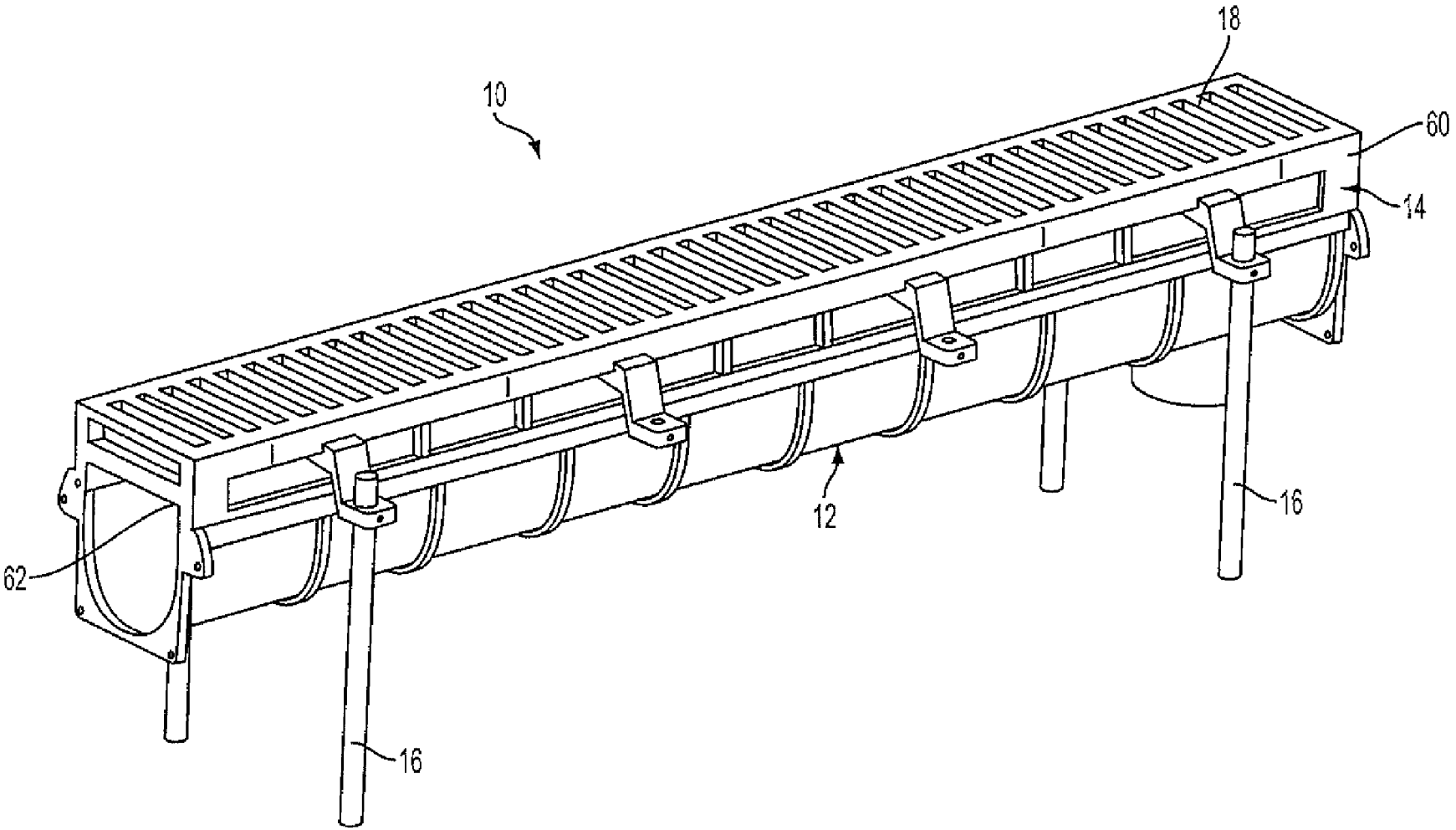
FIG. 1 is an end, top, and side perspective view of an exemplary embodiment of a trench drain assembly constructed in accordance with the present disclosure and including a flow channel, a frame for supporting the channel, rebar for supporting the frame within a trench to be filled with concrete, and a grate for covering the channel.
Figure 2:
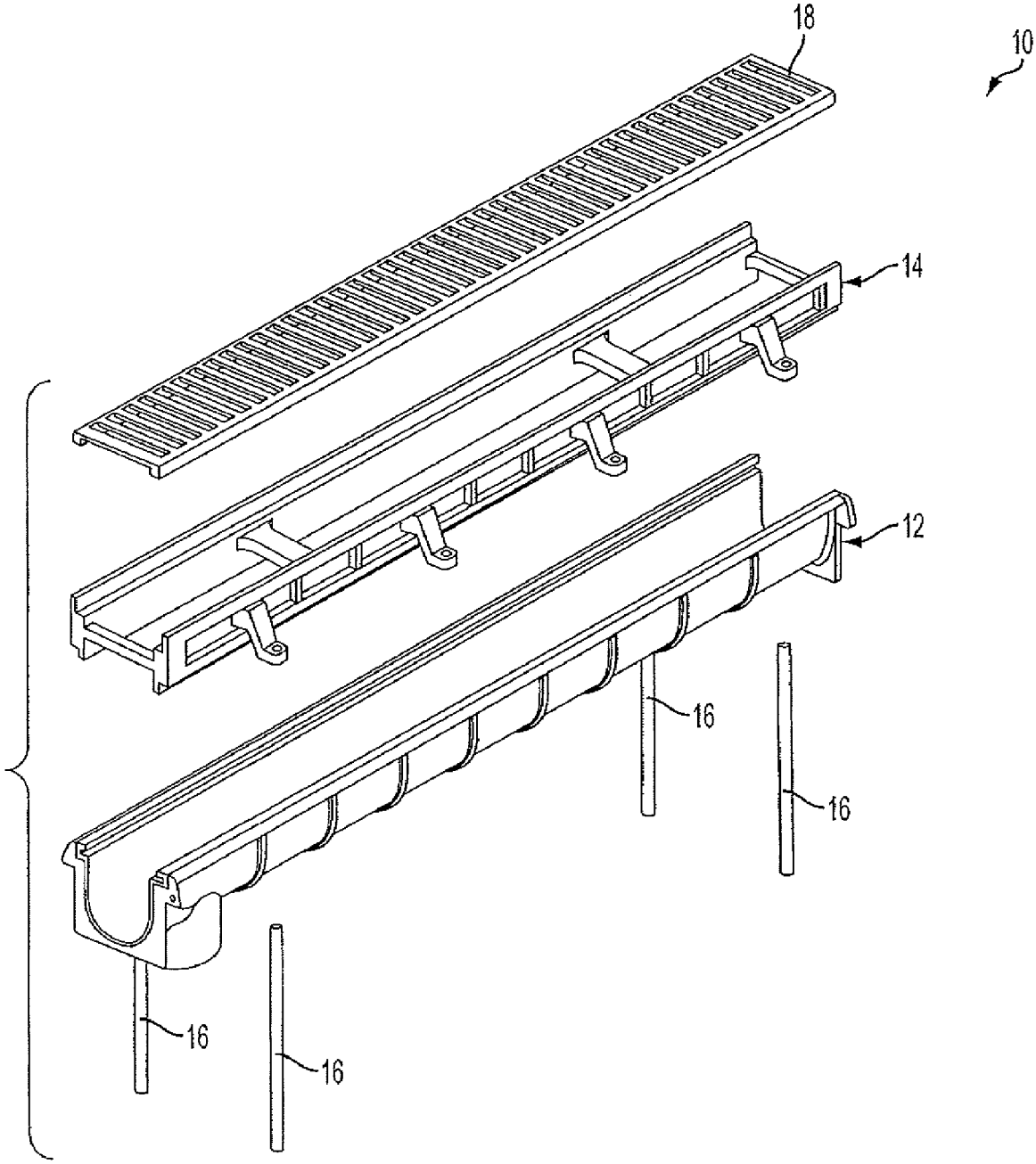
FIG. 2 is an exploded perspective view of the assembly of FIG. 1.
Figure 3:
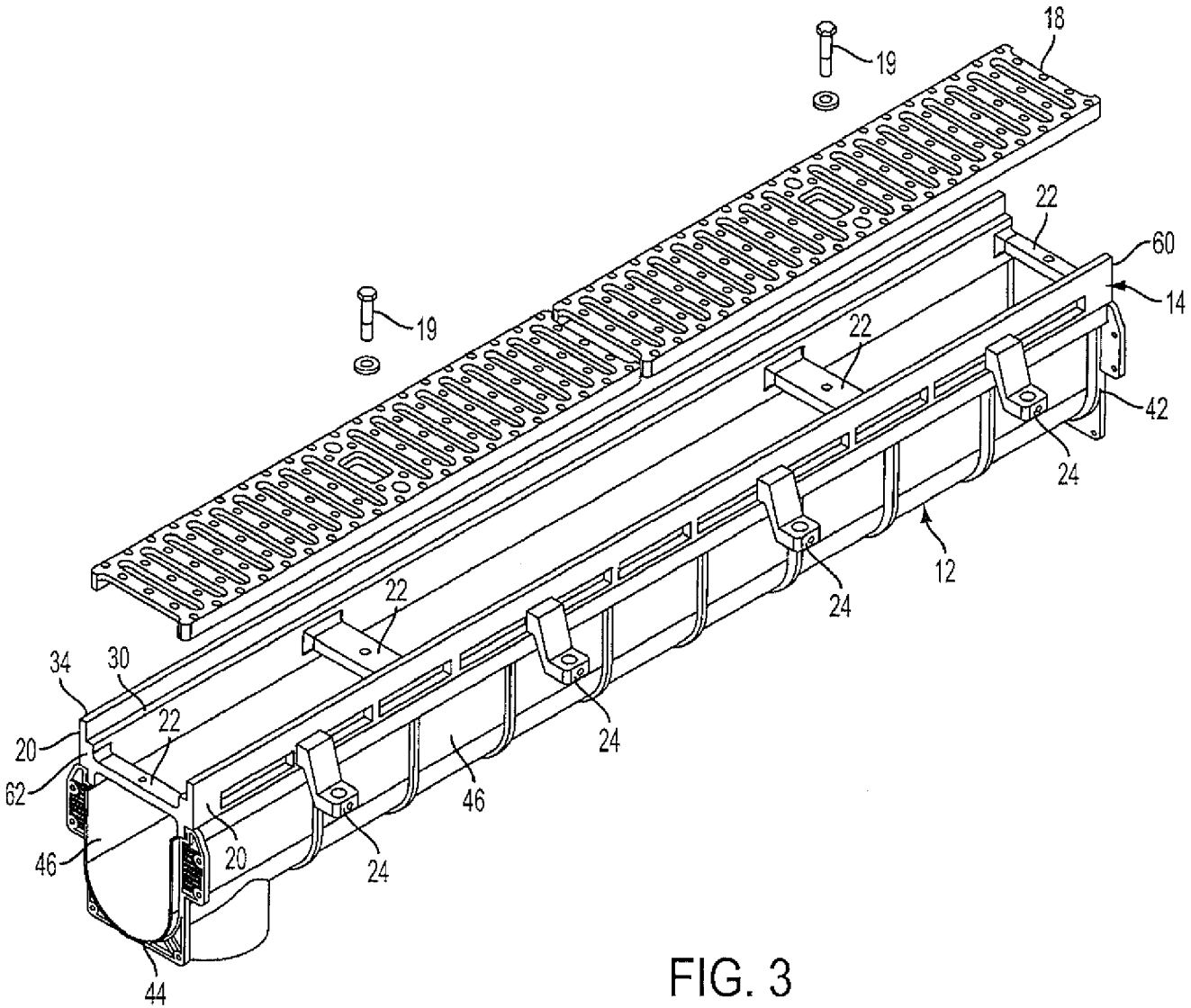
FIG. 3 is an end, top, and side perspective view of the assembly of FIG. 1, wherein the rebar has been removed and the grate is shown exploded from the frame.
Figure 4:
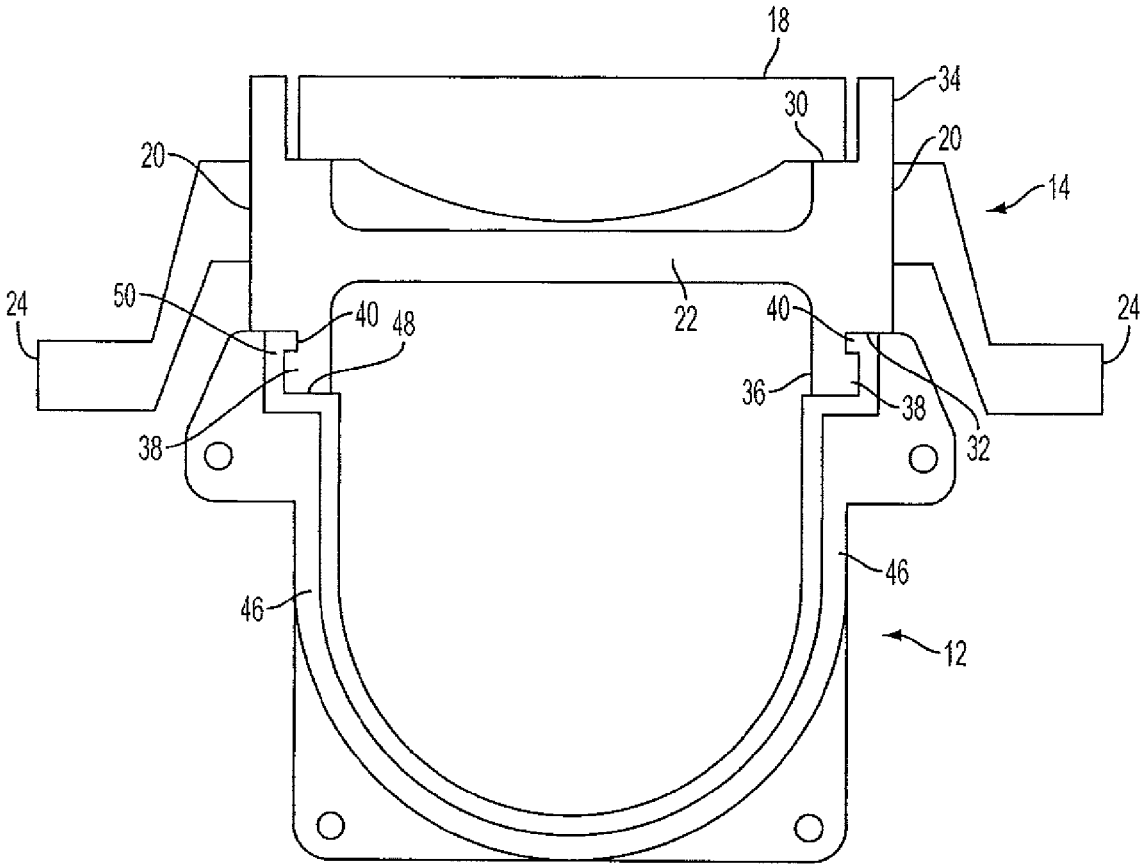
FIG. 4 is an end elevation view of the assembly of FIG. 1, wherein the rebar has been removed.

Referring now to the drawings, an exemplary embodiment of a trench drain assembly 10 constructed in accordance with the present disclosure is shown. As shown in FIGS. 1-2, the assembly 10 includes a flow channel 12, a frame 14 for supporting the channel, rebar 16 for supporting the frame within a trench to be filled with concrete, and a grate 18 for covering the channel. As shown in FIG. 3, the grate 18 can be secured to the frame with bolts 19. According to one exemplary embodiment, the channel 12 is made of injection molded, reinforced thermoplastic, the frame 14 is made of injection molded, reinforced thermoplastic, cast iron, or stainless steel, and the grate 18 is made from injection molded, reinforced thermoplastic, cast iron, or stainless steel.

Figure 5:
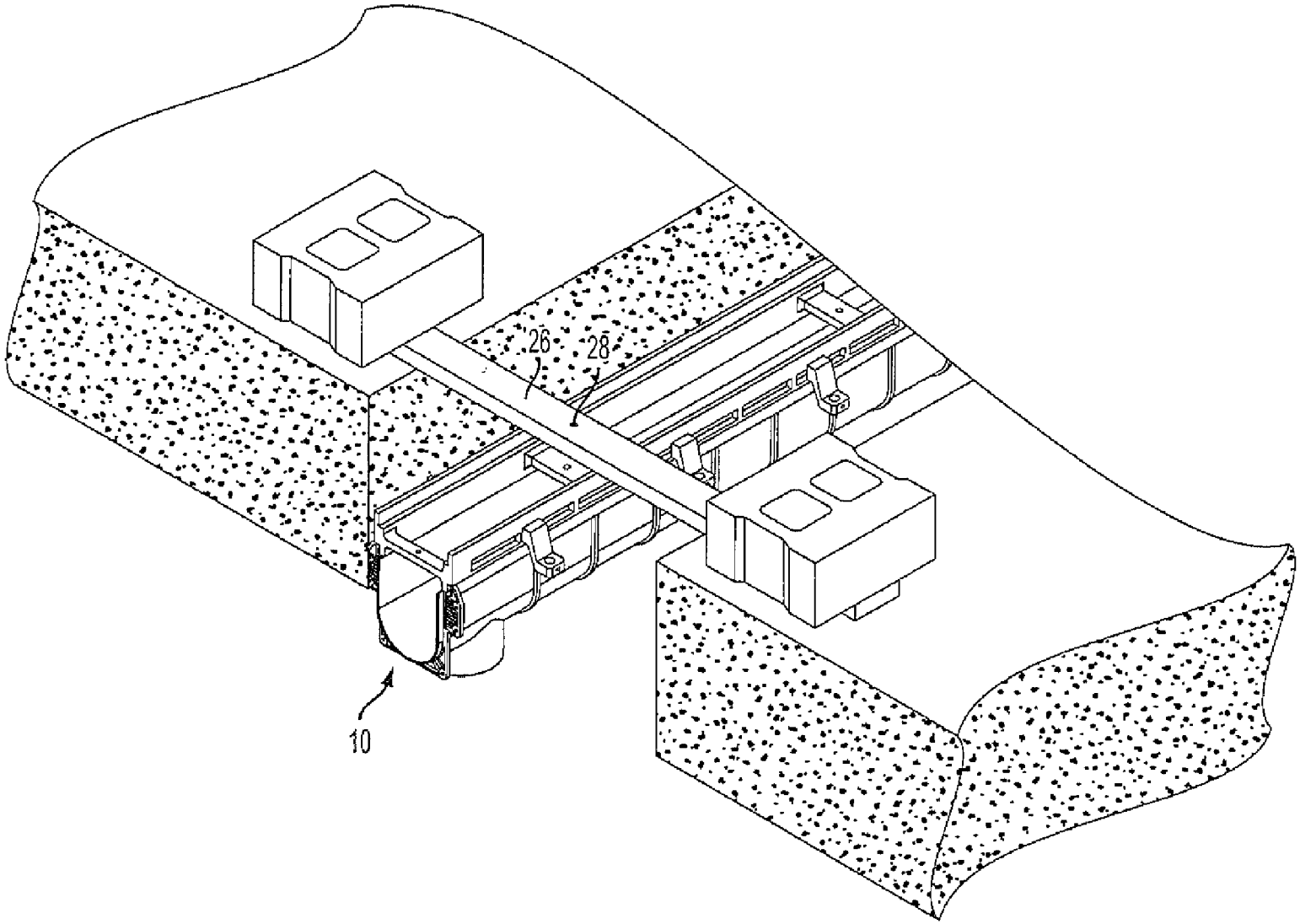
FIG. 5 is an end, top, and side perspective view of the assembly of FIG. 1, wherein the rebar and the grate has been removed, and the assembly is shown positioned in a trench prior to the trench being filled with concrete, and wherein the assembly is shown temporarily supported by a board secured with the grate bolt.
Figure 6:
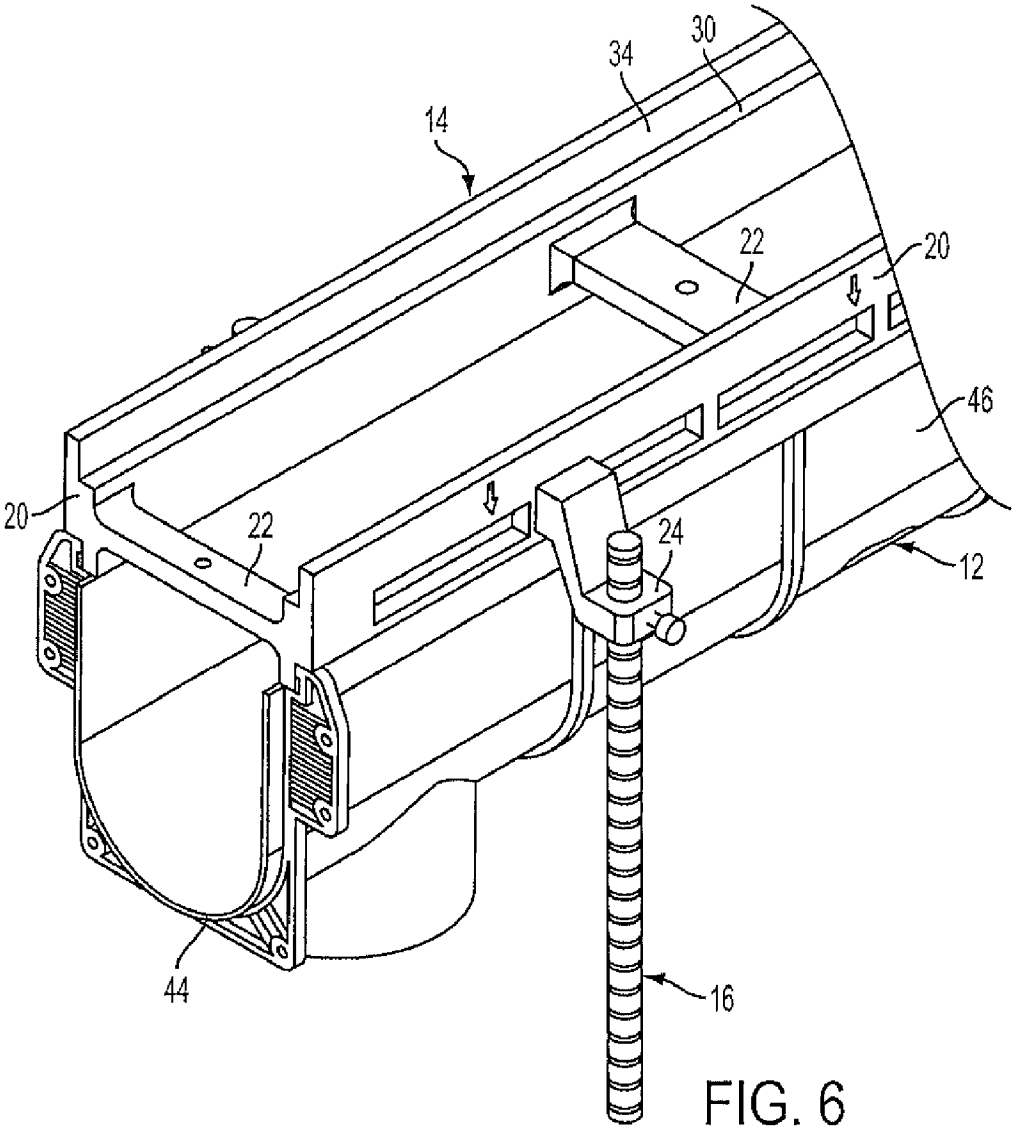
FIG. 6 is an enlarged perspective view of a male end of the assembly of FIG. 1, wherein the grate has been removed.

Referring to FIGS. 1-9 and 12-13, the frame 14 includes two longitudinal sidewalls 20 connected by lateral braces 22, and legs 24 that extend outwardly from the sidewalls. The rebar 16 is adjustably received through the legs 24, as illustrated in FIGS. 1 and 2, to vertically support the frame 14 within a trench prior to the trench being filled with concrete. Alternatively, the frame 14 can be supported from above by a board 26 spanning the trench and secured to one of the lateral braces 22 of the frame 14 with a bolt 28, as illustrated in FIG. 5.

Each of the sidewalls 20 of the frame 14 includes a top surface 30 that receives the grate 18 and a bottom surface 32 that is received on the channel 12, as shown best in FIGS. 4 and 6-9. The sidewalls 20 also include an upwardly extending rim 34 on the top surface 30 for receipt around the grate 18 and a downwardly extending rim 36 on the bottom surface 32 for receipt in the channel 12.

The sidewalls 20 of the frame 14 have a height that increases consistently and gradually between ends 60, 62 of the frame 14 (right to left as shown in the drawings) so that the frame 14 creates a gradual slope (e.g., 0.65% or a 5/16" drop for every 4' of length) for the channel 12 to properly drain. In the exemplary embodiment show, the top surface 30 of the frame 14 is horizontal while the bottom surface 32 is sloped, and the ends 60, 62 of the frame 14 extend normal to the top surface 30. According to one exemplary embodiment, a set of five successively taller frames 14*a*-14*e* are provide wherein each frame has a length between ends 60, 62 of about 4' and the five frames have the following dimensions:

| Frame 14 | Height at the first end 60 | Height at the second end 62 |
|---|---|---|
| a | 1.094" | 1.406" |
| b | 1.406" | 1.719" |
| c | 1.719" | 2.031" |
| d | 2.031" | 2.344" |
| e | 2.344" | 2.656" |

Figure 7:
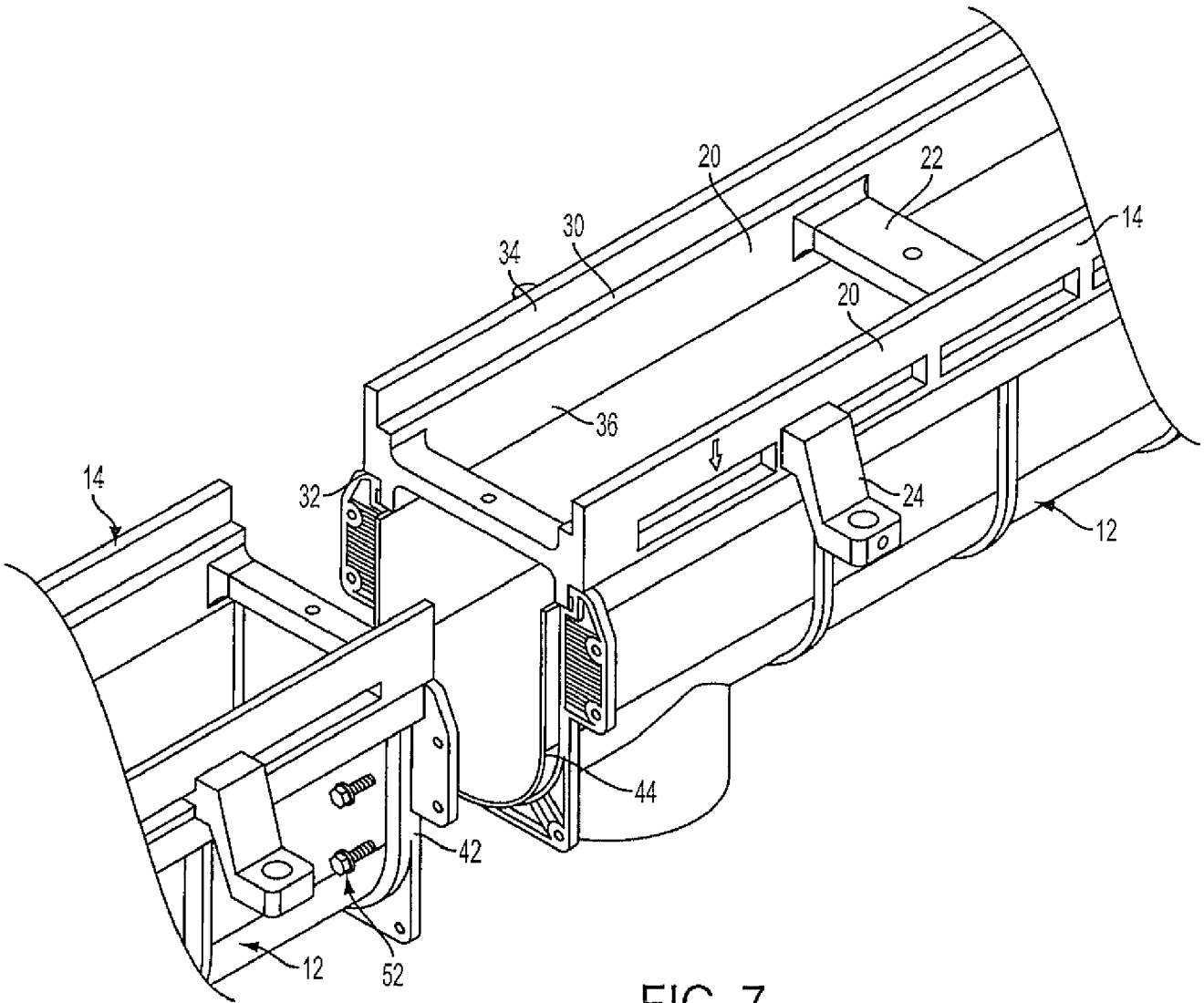
FIG. 7 is an enlarged perspective view of a male end of the assembly of FIG. 1, wherein the grate has been removed and the assembly is illustrated being joined to a female end of a second identical assembly.
Figure 8:
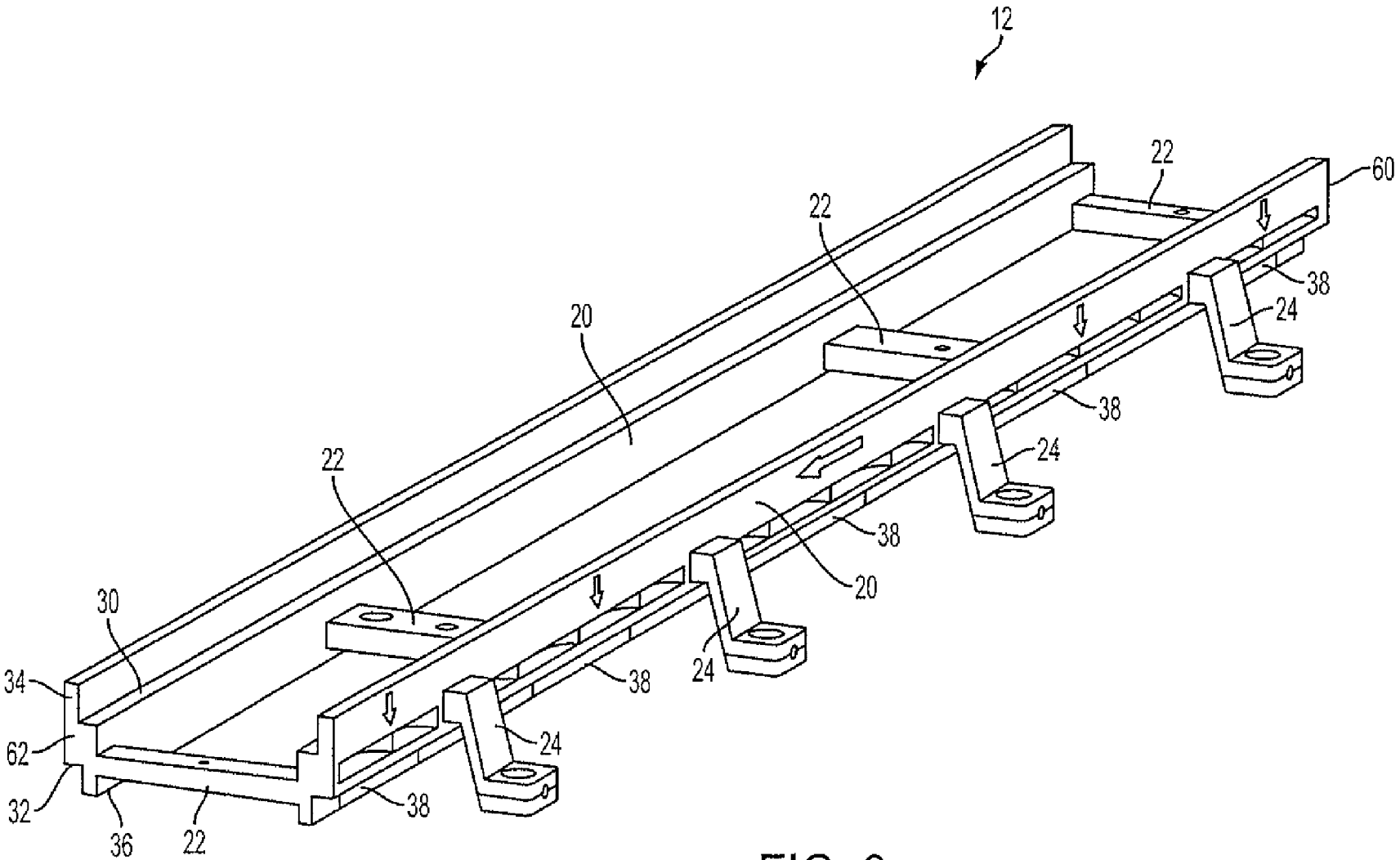
FIG. 8 is an enlarged end, top, and side perspective view of the frame of the assembly of FIG. 1, wherein it can be seen that sidewalls of the frame have a gradually increasing height between ends of the frame (right to left as shown in the drawings) so that the frame creates a gradual slope for the channel to properly drain.
Figure 9:
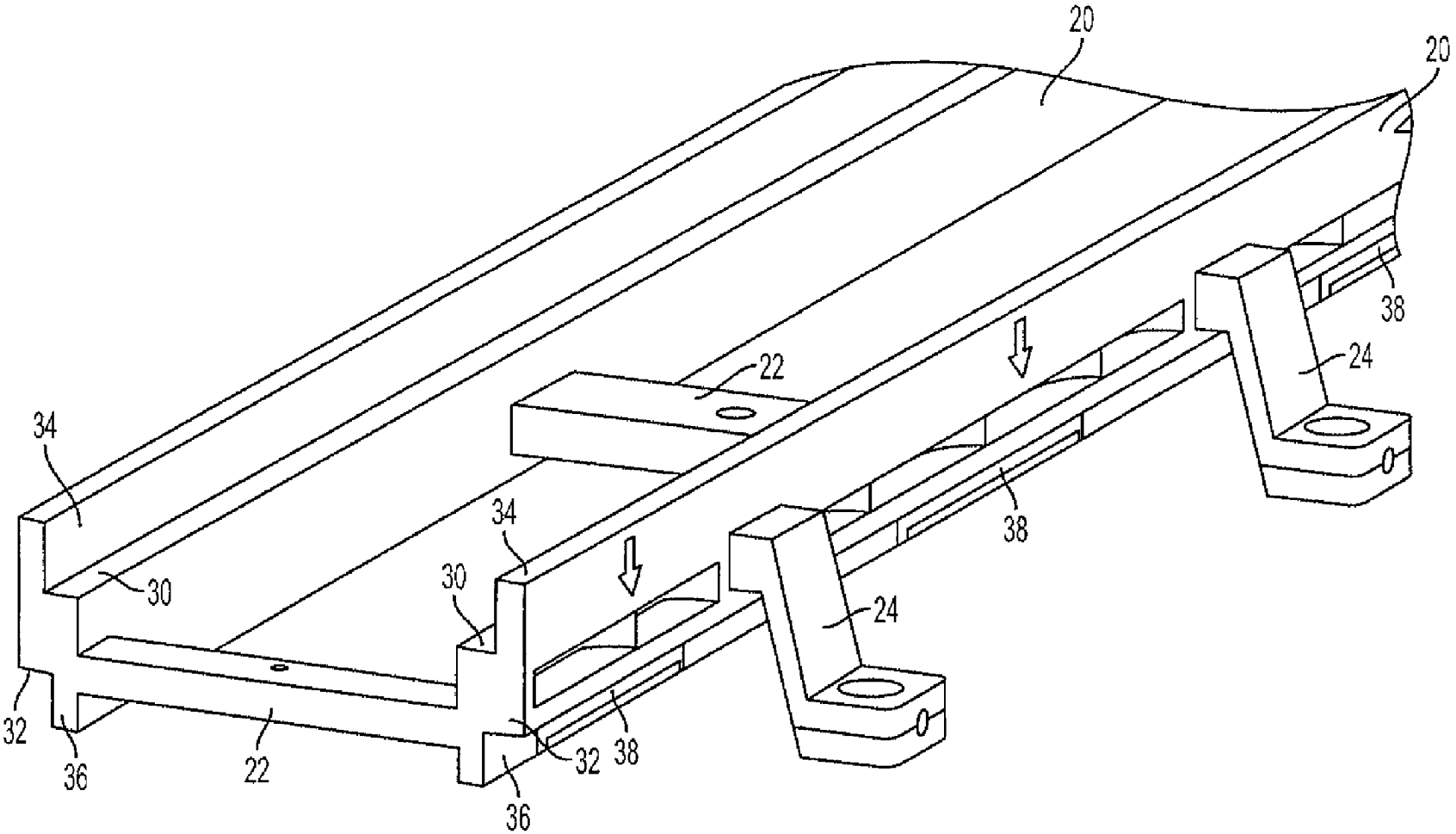
FIG. 9 is a further enlarged end, top, and side perspective view of an end of the frame of the assembly of FIG. 1, wherein it can be seen that the sidewalls of the frame include spaced lugs that extend outwardly.
Figure 10:
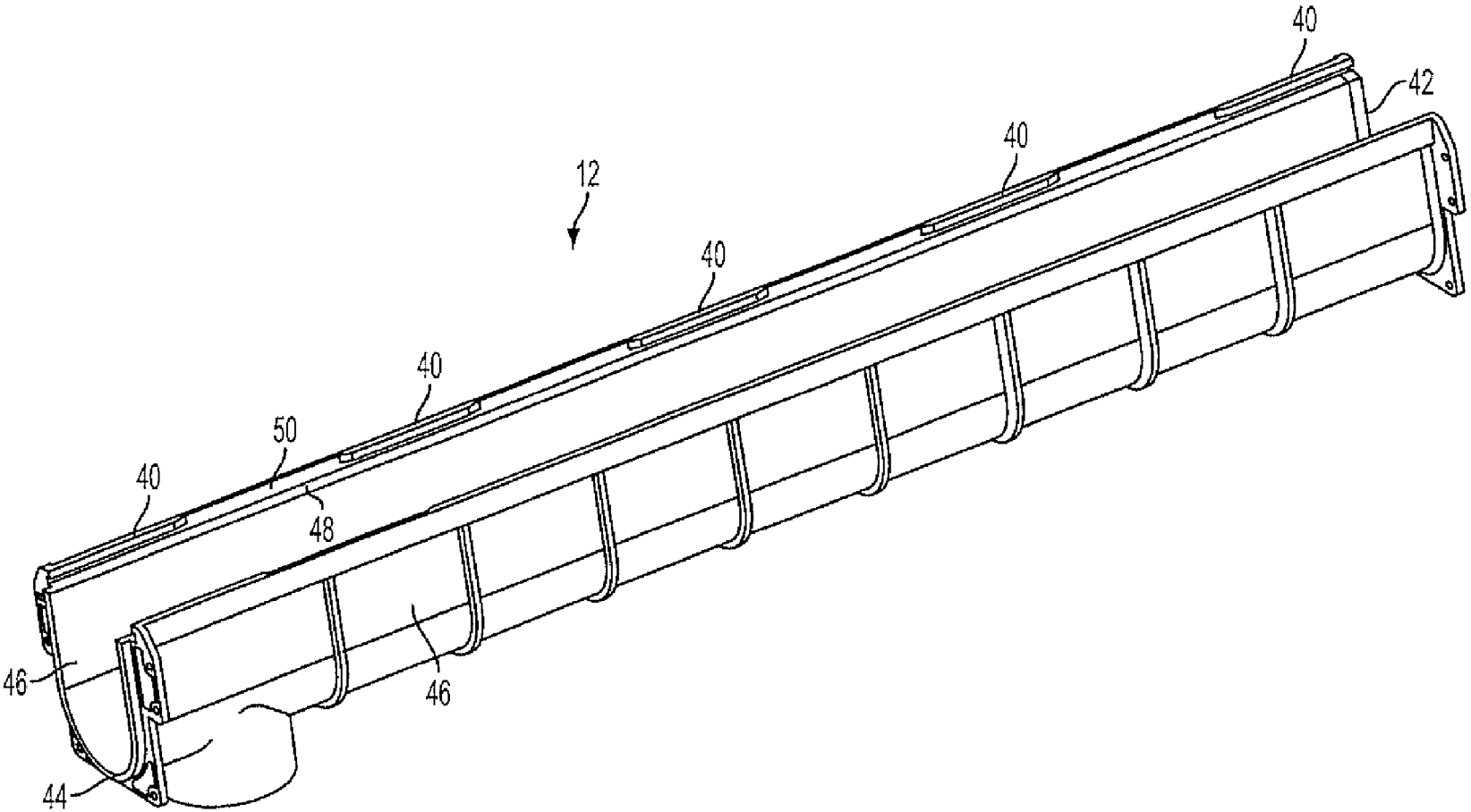
FIG. 10 is an enlarged end, top, and side perspective view of the channel of the assembly of FIG. 1, wherein it can be seen that sidewalls of the channel have a fixed height between ends of the channel so that only the frame creates a gradual slope for the assembly to properly drain.
Figure 11:
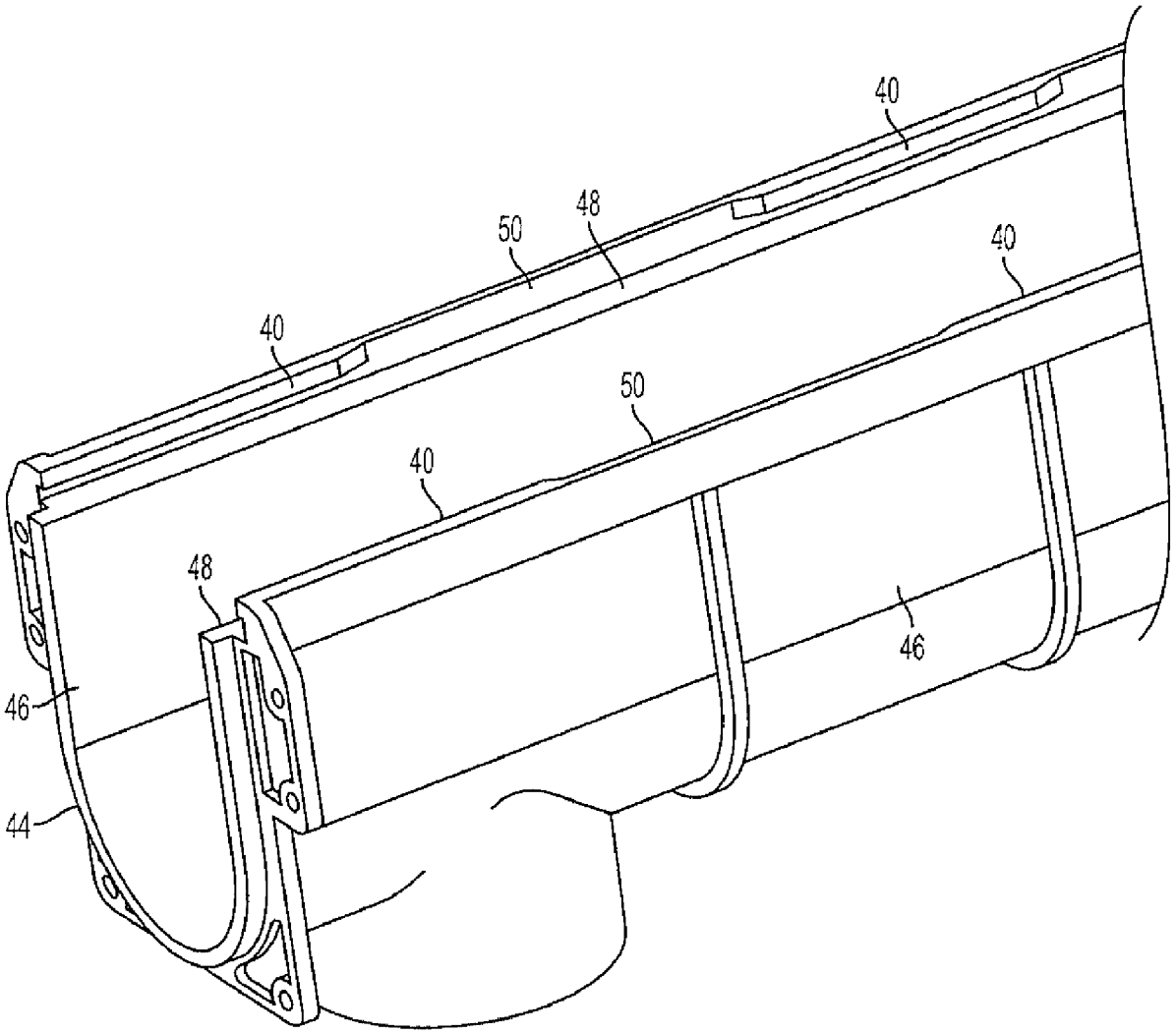
FIG. 11 is a further enlarged end, top, and side perspective view of an end of the channel of the assembly of FIG. 1, wherein it can be seen that the sidewalls of the channel include spaced lugs that extend inwardly to create an interference fit with the lugs of the frame so that the channel can be easily attached to the frame.

As shown in 1-7 and 10-13, the channel 12 has a constant height along its entire length, extends between a female end 42 and a male end 44, and includes sidewalls 46 that each extends upward to a top surface 48. The ends 42, 44 of the channel 12 extend at a slight angle with respect to the top surfaces 48 such that the ends 42, 44 will extend normal with respect to the top surfaces 30 of the frame 14 when the channel is joined to the frame. As illustrated in FIG. 7, the male end 44 of the channel 12 is joined to a female end 42 of another channel 12 during assembly 10, and then can be secured with bolts 52 for example. According to one exemplary embodiment, a set of five successively taller frames 14*a*-14*e*, as described above, are combined with five successively taller channels 12*a*-12*e* wherein each channel has a length between ends 42, 44 of about 4' and the channels have the following heights:

| Channel 12 | Height of Channel |
|---|---|
| a | 4.500" |
| b | 6.062" |
| c | 7.625" |
| d | 9.187" |
| e | 10.75" |

Figure 14:
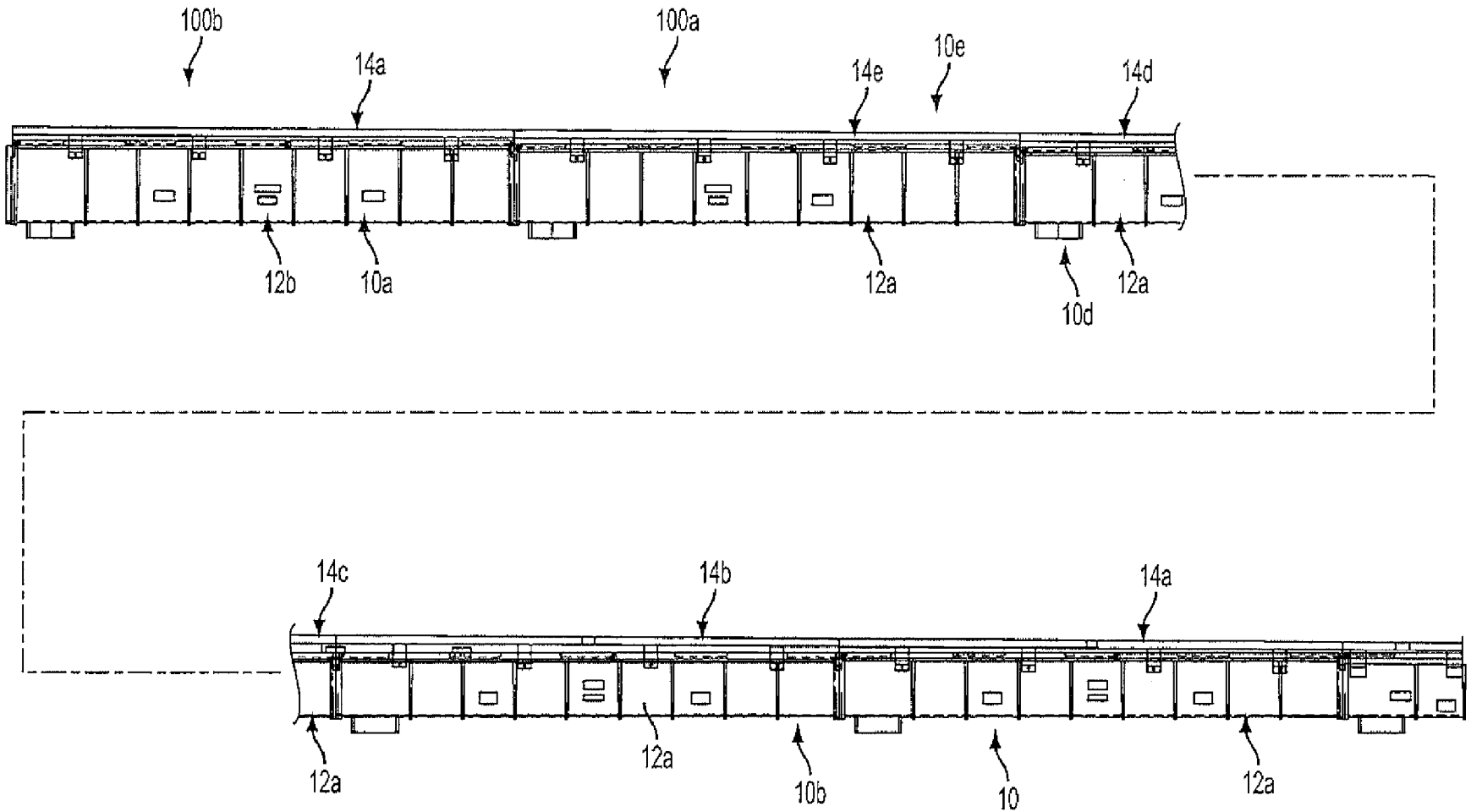
FIG. 14 is a side elevation view of a long span of trench drain created by connecting end-to-end a plurality of trench drain assemblies, such as the assembly of FIG. 1.

Thus, in this example five different frames 14*a*-14*e* can be combined with five different channels 12*a*-12*e* to construct a 100' span having five 20' segments 100*a*-100*e*, wherein each segment 100 comprises five 4' assemblies 10*a*-10*e* and each assembly 10*a*-10*e* includes five channels 12 of the same height, e.g., 4.5". For example, FIG. 14 shows one segment 100*a* comprising five assemblies 10*a*-10*e* constructed from the five frames 14*a*-14*e* and five of the channels 12*a*. A second segment 100*b* is connected to the end of the first segment 100*a*, and the second segment 100*b* uses the taller channel 12*b*. Although not shown in FIG. 14, the third segment 100*c* uses the third channels 12*c*, the fourth segment 100*d* uses the fourth channels 12*d*, and the fifth segment 100*e* uses the fifth channels 12*e*.

As shown best in FIGS. 4, 8, 9, 12, and 13, the sidewalls 20 of the frame 14 also include spaced lugs 38 that extend outwardly and are adapted to catch on corresponding lugs 40 of the channel 12 to secure the frame 14 to the channel 12. In the exemplary embodiment shown, the lugs 38 of the frame 14 extend outwardly from a distal end of the downwardly extending rim 36. As shown best in FIGS. 4 and 10-13, the sidewalls of the channel 12 include an upwardly extending rim 50 on the top surface 48 for receipt around the downwardly extending rim 36 of the frame 14. The lugs 40 of the channel 12 extend inwardly from a distal end of the upwardly extending rim 50.

Figure 12:
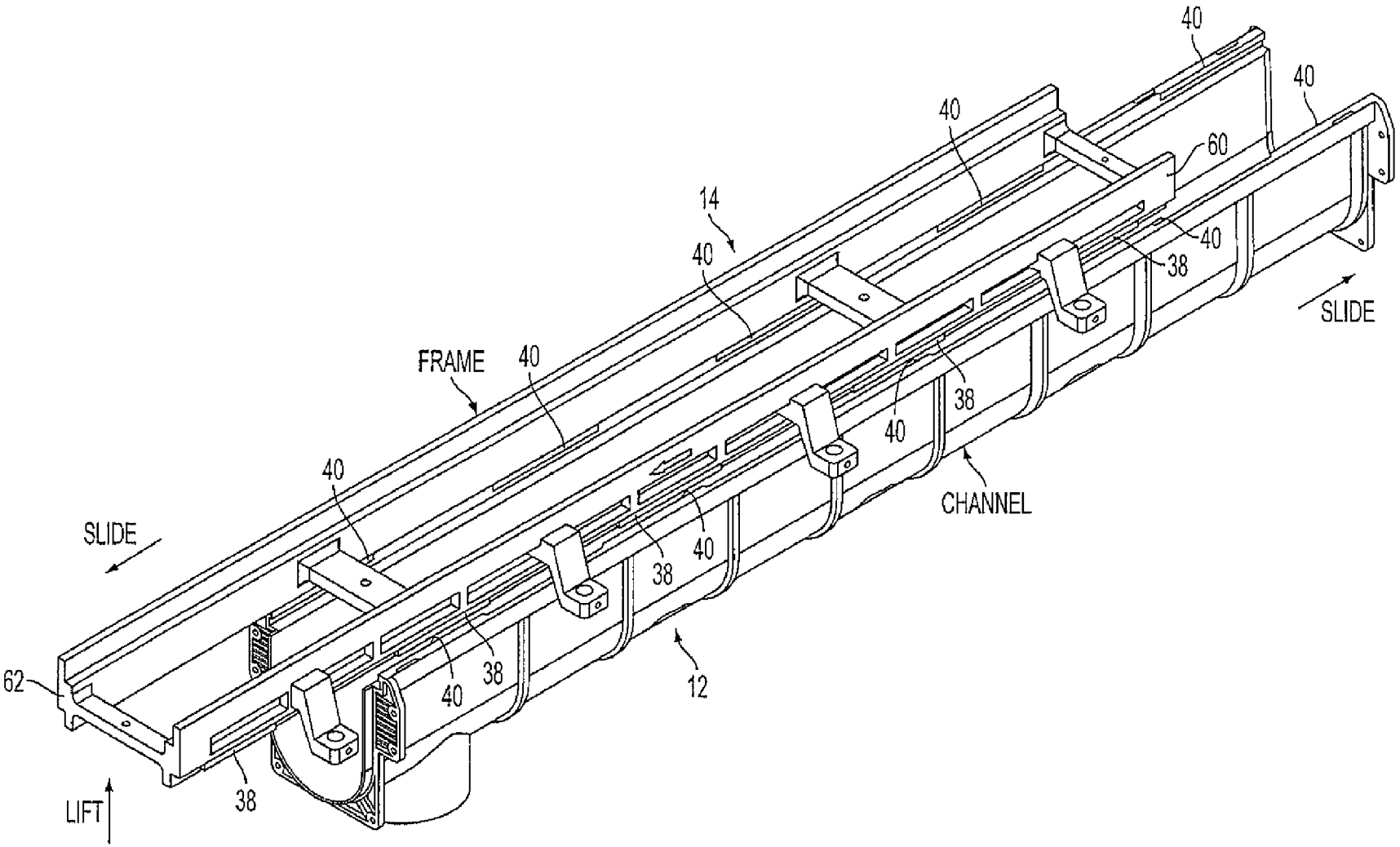
FIG. 12 is an enlarged end, top, and side perspective view of the frame and the channel of the assembly of FIG. 1, wherein the frame is illustrated being removed from the channel by first sliding the frame with respect to the channel until the lugs of the frame become disengaged from the lugs of the channel and then lifting the frame from the channel. During assembly, the frame is first lowered onto the channel so that the lugs of the frame are received between the lugs of the channels and the frame is then slid until the lugs are engaged to secure the frame to the channel.
Figure 13:
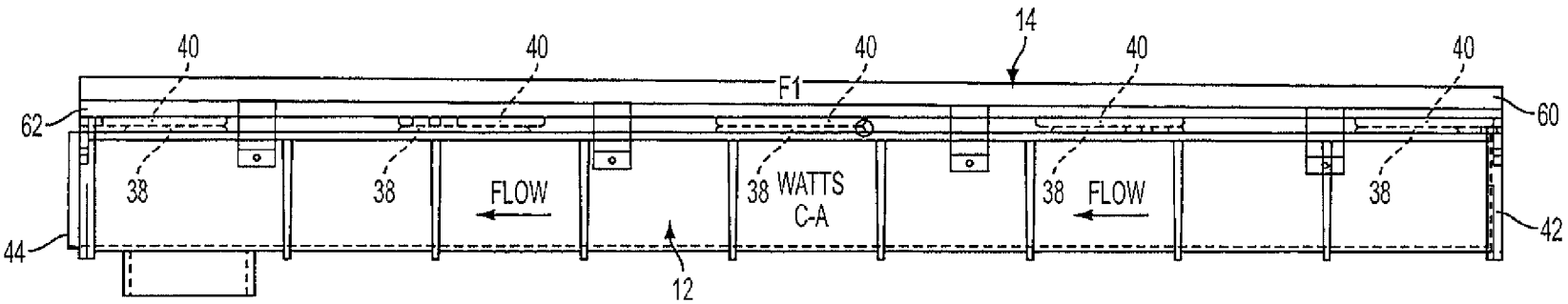
FIG. 13 is a side elevation view of the frame and the channel of the assembly of FIG. 1 shown assembly together, wherein the lugs of the frame are engaged with the lugs of the channel and wherein it can be seen that the sidewalls of the channel have a fixed height and the sidewalls of the frame have a gradually increasing height between ends of the frame (right to left as shown in the drawings) so that the frame creates a gradual slope (e.g., 0.65%) for the channel to properly drain.

Referring to FIG. 12, the frame 14 is illustrated being removed from the channel 12 by first sliding the frame 14 with respect to the channel 12 until the lugs 38 of the frame 14 become disengaged from the lugs 40 of the channel 12 and then lifting the frame 14 from the channel 12. During assembly 10, the frame 14 is first lowered onto the channel 12 so that the lugs 38 of the frame 14 are received between the lugs 40 of the channel 12 and the frame 14 is then slid until the lugs 38, 40 are engaged to secure the frame 14 to the channel 12.

Thus, the present disclosure provides a new and improved trench drain assembly 10. It should be understood, however, that the exemplary embodiments described in this specification have been presented by way of illustration rather than limitation, and various modifications, combinations and substitutions may be effected by those skilled in the art without departure either in spirit or scope from this disclosure in its broader aspects and as set forth in the appended claims. Accordingly, other embodiments are within the scope of the following claims. In addition, the improved trench drain assembly disclosed herein, and all elements thereof, are contained within the scope of at least one of the following claims. No elements of the presently disclosed trench drain assembly are meant to be disclaimed.

What is claimed is:

1. A trench drain assembly comprising:

an elongated flow channel extending longitudinally between first and second ends and including sidewalls that extend upward to top surfaces, wherein the sidewalls have a constant height throughout the entire length of the channel and include spaced lugs that extend inwardly; and a frame for supporting the channel in a trench and including two longitudinal extending sidewalls connected by lateral braces, wherein the sidewalls have: spaced lugs that extend outwardly; bottom surfaces for receipt on the top surfaces of the sidewalls of the channel; and a height that increases consistently and gradually between first and second ends of the frame so that the frame creates a gradual slope for the channel to properly drain, wherein the lugs of the channel and frame are sized and configured such that, in a pre-assembly position, the lugs do not interlock, and, when the frame is slid longitundially to an assembled position, the lugs create an interference fit to secure the frame.

2. A trench drain assembly according to claim 1, wherein the slope created by the frame is a 5/16" drop for every 4' of length.

3. A trench drain assembly according to claim 1, wherein the first end of the channel comprises a female end and the second end of the channel comprises a male end.

4. A trench drain assembly according to claim 1, wherein the ends of the channel extend at a slight angle with respect to the top surfaces of the sidewalls of the channel such that the ends of the channel will extend normal with respect to the top surfaces of the sidewalls of the frame when the channel is joined to the frame.

5. A trench drain assembly according to claim 1, wherein the frame further includes legs that extend outwardly from the sidewalls of the frame and are adapted to receive rebar for supporting the frame in a trench.

6. A trench drain assembly according to claim 1, wherein top surfaces of the sidewalls of the frame are horizontal while the bottom surface of the sidewalls of the frame are sloped.

7. A trench drain assembly according to claim 1, wherein top surfaces of the sidewalls of the frame are horizontal while the bottom surface of the sidewalls of the frame are sloped and the ends of the frame extend normal to the top surface.

8. A trench drain assembly according to claim 1, wherein the frame further includes rims extending downwardly from the bottom surfaces of the sidewalls of the frame and the lugs extend outwardly from a distal end of the downwardly extending rim, and the sidewalls of the channel include upwardly extending rims on the top surfaces of the sidewalls of the channel for receipt around the downwardly extending rims of the frame, and the lugs of the channel extend inwardly from distal ends of the upwardly extending rims.

9. A trench drain assembly according to claim 1, wherein the frame further includes rims extending downwardly from the bottom surfaces of the sidewalls of the frame, and the sidewalls of the channel include upwardly extending rims on the top surfaces of the sidewalls of the channel for receipt around the downwardly extending rims of the frame.

10. A trench drain assembly according to claim 9, further comprising an elongated grate received within the upwardly extending rims of the frame and extending between the sidewalls of the frame.

11. A trench drain assembly according to claim 1, wherein the sidewalls of the frame include upwardly extending rims on the top surfaces of the sidewalls.

12. A trench drain assembly according to claim 1, further comprising an elongated grate received on the top surfaces of the sidewalls of the frame.

13. A trench drain assembly according to claim 12, wherein the frame further includes rims extending downwardly from bottom surfaces of the sidewalls of the frame and the lugs of the frame extend outwardly from a distal end of the downwardly extending rim, and the sidewalls of the channel include upwardly extending rims on top surfaces of the sidewalls of the channel for receipt around the downwardly extending rims of the frame, and the lugs of the channel extend inwardly from distal ends of the upwardly extending rims of the channel.

14. A trench drain assembly according to claim 13, further comprising an elongated grate received within the upwardly extending rims of the frame and extending between the sidewalls of the frame.

15. A trench drain assembly according to claim 12, wherein the sidewalls of the frame include upwardly extending rims on top surfaces of the sidewalls.

16. A trench drain assembly according to claim 12, further comprising an elongated grate received on top surfaces of the sidewalls of the frame.

17. A trench drain assembly according to claim 12, wherein the first end of the channel comprises a female end and the second end of the channel comprises a male end.

18. A trench drain assembly according to claim 12, wherein the frame further includes legs that extend outwardly from the sidewalls of the frame and are adapted to receive rebar for supporting the frame in a trench.

19. A trench drain assembly comprising:

an elongated flow channel extending longitudinally between first and second ends, wherein laterally spaced sidewalls of the channel have a constant height throughout the entire length of the channel; and a frame for supporting the channel in a trench and including two longitudinal extending and laterally spaced sidewalls for receipt on the sidewalls of the channel, wherein the sidewalls of the frame have a height that increases consistently and gradually between first and second ends of the frame so that the frame creates a gradual slope for the channel to properly drain;

wherein the sidewalls of the frame include spaced lugs that extend laterally outwardly and the sidewalls of the channel include spaced lugs that extend laterally inwardly to create an interference fit with the lugs of the frame in an assembled position, which requires sliding the frame longitudinally to create and release the interference fit.

* * * * *